US007144479B2

(12) United States Patent
Davis et al.

(10) Patent No.: US 7,144,479 B2
(45) Date of Patent: Dec. 5, 2006

(54) METHOD FOR INCREASING PRESS FABRIC VOID VOLUME BY LASER ETCHING

(75) Inventors: Trent W. Davis, Mansfield, MA (US); James G. Donovan, Norwell, MA (US)

(73) Assignee: Albany International Corp., Albany, NY (US)

( * ) Notice: Subject to any disclaimer, the term of this patent is extended or adjusted under 35 U.S.C. 154(b) by 504 days.

(21) Appl. No.: 10/417,370

(22) Filed: Apr. 16, 2003

(65) Prior Publication Data

US 2004/0250976 A1 Dec. 16, 2004

(51) Int. Cl.
*D21F 1/10* (2006.01)
*D21F 7/08* (2006.01)

(52) U.S. Cl. ..... 162/358.2; 162/348; 162/900; 162/902; 162/903; 428/131; 216/95; 216/56

(58) Field of Classification Search ..... 162/109–117, 162/348, 306, 358.2, 358.4, 358.1, 361, 900–904; 34/116, 120; 428/131, 134–138; 139/383 A, 139/425 A; 216/94, 95, 7, 52, 53, 56
See application file for complete search history.

(56) References Cited

U.S. PATENT DOCUMENTS 4,206,258 A * 6/1980 Balcar ..... 428/131
4,300,982 A 11/1981 Romanski
4,446,187 A * 5/1984 Eklund ..... 428/136
4,537,658 A * 8/1985 Albert ..... 162/348
4,541,895 A 9/1985 Albert
4,701,368 A 10/1987 Kiuchi et al.
4,885,090 A 12/1989 Chupka et al.
5,017,423 A 5/1991 Bossman et al.
5,064,537 A 11/1991 Chupka et al.
5,346,567 A 9/1994 Barnewall
5,837,102 A * 11/1998 Graf ..... 162/296
5,972,813 A * 10/1999 Polat et al. ..... 442/320
6,080,691 A * 6/2000 Lindsay et al. ..... 442/381
6,340,413 B1 * 1/2002 Nilsson et al. ..... 162/361
6,726,809 B1 * 4/2004 Joyce et al. ..... 162/358.1
2004/0118546 A1 * 6/2004 Bakken et al. ..... 162/348

OTHER PUBLICATIONS

International Search Report issued by the European Patent Office for corresponding international application No. PCT/US2004/010636 mailed Oct. 11, 2004.

* cited by examiner

*Primary Examiner*—Eric Hug
(74) *Attorney, Agent, or Firm*—Frommer Lawrence & Haug LLP; Ronald R. Santucci

(57) ABSTRACT

A method whereby a water permeable press fabric is given greater dewatering and drainage capacity by providing voids which are reservoirs of minimum pressure available to accept water.

22 Claims, 1 Drawing Sheet

Laser etching of voids

Simple Square array of hemispherical voids

Square Array of Triangular Pyramidal voids

METHOD FOR INCREASING PRESS FABRIC VOID VOLUME BY LASER ETCHING

FIELD OF THE INVENTION

The present invention relates to the papermaking arts. More specifically, the present invention relates to a method whereby a water permeable press fabric is given greater dewatering and drainage capacity by providing voids.

BACKGROUND OF THE INVENTION

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

The present invention relates primarily to the fabrics used in the press section, generally known as press fabrics, but it may also find application in the fabrics used in other paper industry processes.

Press fabrics play a critical role during the paper manufacturing process. One of their functions, as implied above, is to support and to carry the paper product being manufactured through the press nips.

Press fabrics also participate in the finishing of the surface of the paper sheet. That is, press fabrics are designed to have smooth surfaces and uniformly resilient structures, so that, in the course of passing through the press nips, a smooth, mark-free surface is imparted to the paper.

Perhaps most importantly, the press fabrics accept the large quantities of water extracted from the wet paper in the press nip. In order to fulfill this function, there literally must be space, commonly referred to as void volume, within the press fabric for the water to go, and the fabric must have adequate permeability to water for its entire useful life.

Finally, press fabrics must be able to prevent the water accepted from the wet paper from returning to and rewetting the paper upon exit from the press nip.

Contemporary press fabrics are used in a wide variety of styles designed to meet the requirements of the paper machines on which they are installed for the paper grades being manufactured. Generally, they comprise a woven base fabric into which has been needled a batting of fine, nonwoven fibrous material. The base fabrics may be woven from monofilament, plied monofilament, multifilament or plied multifilament yarns, and may be single-layered, multilayered or laminated. The yarns are typically extruded from any one of several synthetic polymeric resins, such as polyamide and polyester resins, used for this purpose by those of ordinary skill in the paper machine clothing arts.

Woven fabrics take many different forms. For example, they may be woven endless, or flat woven and subsequently rendered into endless form with a seam. Alternatively, they may be produced by a process commonly known as modified endless weaving, wherein the widthwise edges of the base fabric are provided with seaming loops using the machine-direction (MD) yarns thereof. In this process, the MD yarns weave continuously back and forth between the widthwise edges of the fabric, at each edge turning back and forming a seaming loop. A base fabric produced in this fashion is placed into endless form during installation on a paper machine, and for this reason is referred to as an on-machine-seamable fabric. To place such a fabric into endless form, the two widthwise edges are seamed together. To facilitate seaming, many current fabrics have seaming loops on the crosswise edges of the two ends of the fabric. The seaming loops themselves are often formed by the machine-direction (MD) yarns of the fabric. The seam is typically formed by bringing the two ends of the fabric press together, by interdigitating the seaming loops at the two ends of the fabric, and by directing a so-called pin, or pintle, through the passage defined by the interdigitated seaming loops to lock the two ends of the fabric together.

Further, the woven base fabrics may be laminated by placing one base fabric within the endless loop formed by another, and by needling a staple fiber batting from one or both of the sheet side or machine side of the base fabrics through both base fabrics to join them to one another. One or both woven base fabrics may be of the on-machine-seamable type.

Other structures can be used as the "base" fabric for a press fabric such as extruded meshes, knitted structures, or other nonwoven products such as foils, films, or spunbonds.

In any event, the press fabrics are in the form of endless loops, or are seamable into such forms, having a specific length, measured longitudinally therearound, and a specific width, measured transversely thereacross.

Returning now to the dewatering function of the above-described press fabrics, it has been shown previously that introducing surface indentations or voids into a press fabric structure may improve water transfer through the fabric. The present invention provides an alternative method of making these improvements.

SUMMARY OF THE INVENTION

Accordingly, the present invention is a method whereby a finished water permeable press fabric is given greater dewatering and drainage capacity by providing backside voids which are reservoirs of minimum pressure available to accept water.

DETAILED DESCRIPTION OF THE INVENTION

Figure 1:
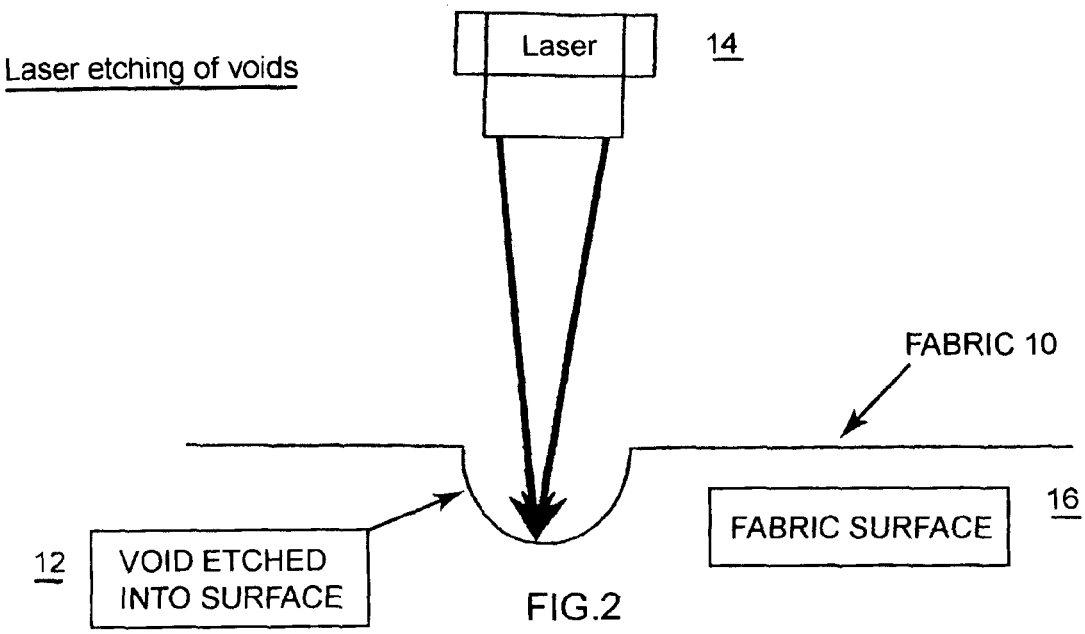
FIG. 1 is a side view illustrating the method of the present invention.

FIG. 1 illustrates the method according to the present invention wherein a fabric 10, for example, a conventional water permeable press fabric, is given greater dewatering and drainage capacity by providing voids 12, or reservoirs of minimum pressure, on the fabric back surface 16 which are available to accept water. When drilled on a backside surface 16 of fabric 10 using a laser 14, the macro-voids 12 have a breadth and a depth, for example, in the range of approximately 0.30 to 1.50 mm.

Figure 2:
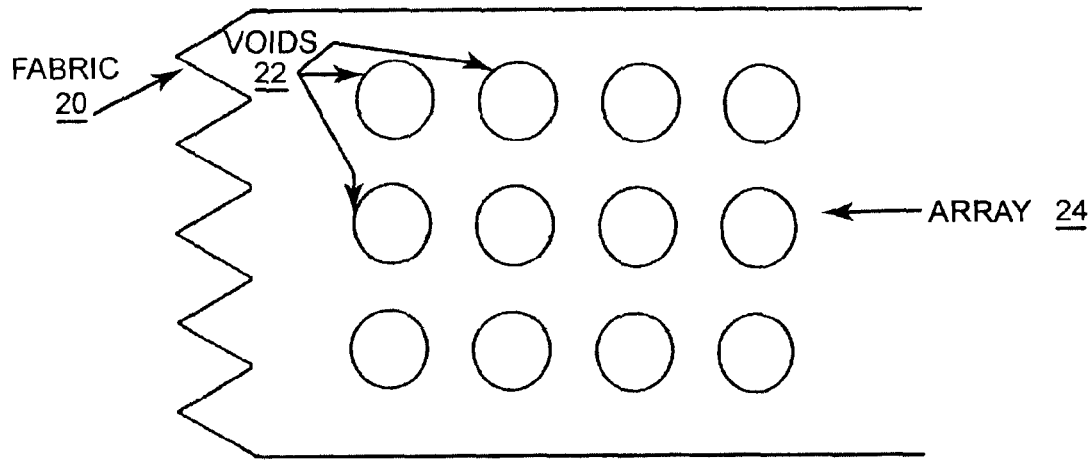
FIG. 2 is a plan view of one example of an array of voids produced by the method shown in FIG. 1.
Figure 3:
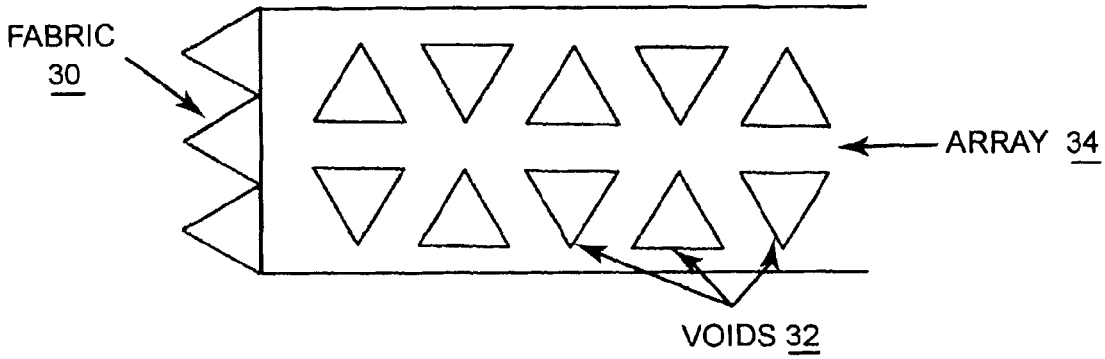
FIG. 3 is a plan view of another configuration for an array of voids.

The laser 14, which may be, for example, a small medical laser, is used to selectively etch the voids 12 in the surface 16 of the fabric 10. This allows very accurate depth profile control of the removed material. Of course other laser etching devices suitable for the purpose may also be used. In addition, conventional laser etching control systems (not shown) may be used to impart the desired void pattern or profile at great speed, while also providing great flexibility in void design and size. Typical configurations include a square array 24 of hemispherical voids 22 in the fabric 20 shown in FIG. 2, or a square array 34 of triangular pyramidal voids 32 in the fabric 30 illustrated in FIG. 3. Other void designs and sizes may include, for example, circular/hemispherical, square/pyramidal, rectangular/cuboid, hexagonal, elliptical (cross-machine-direction/machine-direction orientation), annular/demitoroidal, and grooved. Other void array patterns may include, for instance, hexagonal, pseudo random, triangular, and linear/spiral (for example, grooved).

In addition, the method of the present invention may include steps (not shown) for handling contingencies such as fiber removal from the voids and gaseous vaporization by-products.

Although laser drilling holes in press fabrics has been previously proposed, the present invention is distinct from the prior art in several important respects. For example, one previous method (U.S. Pat. No. 4,541,895) prescribes laser drilling "through holes" in impervious sheets prior to their assembly into fabric to provide water channels continuous through the entire structural thickness. The present invention, on the other hand, instead modifies a water permeable press fabric to give it greater dewatering and drainage capacity, by providing laser-drilled backside voids, or reservoirs of minimum pressure, that are available to accept water.

Another prior patent (U.S. Pat. No. 4,300,982) provides drainage voids on the backside of a belt, but by means very different than the present invention, that is, by providing raised incompressible islands of monofilaments. Yet another prior patent (U.S. Pat. No. 4,446,187) describes laser drilling holes on a surface of a liquid impermeable material defined as a "foil". The expressed purpose is to obtain a dewatering belt possessing an even pressure distribution and a smooth paper-contact surface made liquid permeable by laser drilling holes. In contrast, the present invention specifies laser drilling on the backside surface of a liquid permeable fabric to provide fluid reservoirs, or areas of low pressure, to facilitate dewatering.

Additionally or alternatively, micro-voids may be drilled on a faceside of fabric 10 to similarly enhance void volume, fluid flow and drainage without adversely affecting the surface qualities of the fabric 10.

As understood from the foregoing description of the method for creating additional void volume in a fabric, modifications would be obvious to those of ordinary skill in the art, but would not bring the invention so modified beyond the scope of the appended claims.

What is claimed is:

1. A method of modifying a fabric comprising the steps of:

providing a finished water permeable papermaker's fabric; and forming a plurality of laser etched blind-drilled voids in a surface of the fabric;

wherein by forming said plurality of laser etched blind-drilled voids in the surface of the fabric provides reservoirs of minimum pressure for acceptance of water, thereby enhancing the fabric's dewatering capacity.

2. The method of claim 1 wherein the fabric to be modified is a papermakers' press fabric.

3. The method of claim 1 wherein the surface is the backside of the fabric.

4. The method of claim 1 wherein both a backside and a faceside of the fabric have voids formed thereon.

5. The method of claim 1 wherein a breadth and a depth of the voids are both in the range of approximately 0.30 to 1.50 mm.

6. The method of claim 1 wherein the laser is used to selectively vaporize material in the faceside or sheet contact side of the fabric to produce micro-voids which do not adversely affect the fabric's surface qualities.

7. The method of claim 1 wherein a conventional laser is used to control the profile of each void and the pattern of voids.

8. The method of claim 1 wherein each void has a breadth/depth shape selected from the group consisting circular/hemispherical, square/pyr-amidal, rectangular/cuboid, hexagonal, elliptical, annular/demitoroidal, and grooved.

9. The method of claim 1 wherein the voids form an array pattern selected from the group comprising square, hexagonal, pseudo random, triangular, and linear/spiral.

10. The method of claim 1 further comprising the step of handling fiber removal and gaseous vaporization by-products.

11. A water permeable papermaker's fabric given greater dewatering and drainage capacity, said fabric being made in a manner comprising the step of providing laser etched blind-drilled voids which are reservoirs of minimum pressure available to accept water.

12. A modified fabric being made in the manner comprising the steps of:

providing a finished water permeable papermaker's fabric; and forming a plurality of laser etched blind-drilled voids in a surface of the fabric, thereby enhancing the fabric's dewatering capacity.

13. The fabric of claim 12 wherein the laser etched blind-drilled voids are reservoirs of minimum pressure that are available to accept water.

14. The fabric of claim 12 wherein the fabric to be modified is a papermakers' press fabric.

15. The fabric of claim 12 wherein the surface is the backside of the fabric.

16. The fabric of claim 12 wherein both a backside and a faceside of the fabric have voids formed thereon.

17. The fabric of claim 12 wherein a breadth and a depth of the voids are both in the range of approximately 0.30 to 1.50 mm.

18. The fabric of claim 12 wherein the laser is used to selectively vaporize material in the faceside or sheet contact side of the fabric to produce micro-voids which do not adversely affect the fabric's surface qualities.

19. The fabric of claim 12 wherein the modified fabric is for use in the press section of a papermaking machine.

20. The fabric of claim 12 wherein a conventional laser is used to control the profile of each void and the pattern of voids.

21. The fabric of claim 12 wherein each void has a breadth/depth shape selected from the group comprising circular/hemispherical, square/pyr-amidal, rectangular/cuboid, hexagonal, elliptical, annular/demitoroidal, and grooved.

22. The fabric of claim 12 wherein the voids form an array pattern selected from the group comprising square, hexagonal, pseudo random, triangular, and linear/spiral.

* * * * *